US006773299B2

(12) United States Patent
Sawayanagi

(10) Patent No.: US 6,773,299 B2
(45) Date of Patent: Aug. 10, 2004

(54) CONNECTION STRUCTURE OF FLAT CABLE TO CONNECTOR

(75) Inventor: Masahiro Sawayanagi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/043,101

(22) Filed: Jan. 14, 2002

(65) Prior Publication Data

US 2002/0094718 A1 Jul. 18, 2002

(30) Foreign Application Priority Data

Jan. 15, 2001 (JP) ..... 2001-006504

(51) Int. Cl.[7] ..... H01R 9/07
(52) U.S. Cl. ..... 439/499
(58) Field of Search ..... 439/499, 495, 439/417, 470, 402, 76, 67, 176, 493, 632, 490

(56) References Cited

U.S. PATENT DOCUMENTS 4,381,132 A 4/1983 Tournier
5,433,625 A 7/1995 Tsuji et al.
5,885,091 A * 3/1999 Beclanger, Jr. et al. ..... 439/67
5,954,537 A * 9/1999 Sonobe et al. ..... 439/495

FOREIGN PATENT DOCUMENTS

WO WO 99/16150 4/1999

OTHER PUBLICATIONS

European Search Report dated Aug. 6, 2003.

* cited by examiner

*Primary Examiner*—Ross Gushi
*Assistant Examiner*—Phuongchi Nguyen
(74) *Attorney, Agent, or Firm*—Finnegan, Henderson, Farabow, Garrett & Dunner, L.L.P.

(57) ABSTRACT

A connection structure consists of a connector housing protruded from a base plate, a plurality of terminals housed in the connector housing, a flat cable and a cover capped on the connector housing and the flat cable. Said each terminal has a press-fit contact at one end thereof and the press-fit contact is protruded from the surface of the connector housing. The flat cable consists of a plurality of conductors and is pressed by the cover to the surface of the connector housing so that the conductors are in contact with the press-fit contacts respectively. There are provided a pair of slits between the cover and the base plate wherefrom the flat cable is drawn so that the direction can be changed.

4 Claims, 8 Drawing Sheets

CONNECTION STRUCTURE OF FLAT CABLE TO CONNECTOR

BACKGROUND OF THE INVENTION

1. Field of the Invention

This invention relates to a connection structure of a flat cable connected to a connector at an intermediate portion thereof, which is applied, for example, to an electrical connection of a flat cable laid in a roof of a vehicle to an auxiliary component.

2. Description of the Related Art

In a vehicle interior, sunvisors for a driver and a passenger seat occupant are provided above a front window. Some sorts of sunvisors are provided with vanity mirrors and/or illumination lamps for nighttime.

A sunvisor with a lamp is provided with a bracket at the distal end of a fixing shaft for fixing the sunvisor to the interior of a vehicle. A roof of a vehicle is provided with another bracket for connection with the bracket. The sunvisor is fixed to the roof by connecting the both brackets with each other.

A plurality of cables are laid in the roof to supply electric power for the brackets described above. The illumination lamp of the sunvisor is supplied with electric power from the cable via a connector provided with the bracket. In addition to the sunvisor, a plurality of auxiliary components which need electric power are equipped at the vehicle roof. Cables are laid and connected with the respective components.

SUMMARY OF THE INVENTION

Recent vehicles are provided with many auxiliary components which need electric supply so that a total weight and cost of cables reach a considerable level. Though a flat cable can be applied to save the weight, a flat cable is easy to be curved in a direction vertical to the flat surface thereof but is hardly curved in an in-plane direction. To change a direction of drawing the flat cable, there are no ways but multifolding it. So it is difficult to draw a flat cable to a plurality of connectors with accuracy.

It is an object of the present invention to provide a connection structure of a flat cable to a connector which makes it possible that a plurality of connectors can be connected to a flat cable and the flat cable is easy to be drawn in any direction.

A connection structure according to the present invention comprises a connector housing integrally protruded from a base plate thereof, a plurality of terminals housed in the connector housing, a flat cable in contact with the terminals and a cover covering the connector housing and the flat cable. The connector housing comprises a first surface substantially parallel to the base plate and a pair of side surfaces on both sides of the first surface. Said each terminal comprises a press-fit contact at one end thereof and the press-fit contact is protruded from the first surface of the connector housing. The flat cable comprises a plurality of conductors each in contact with the respective press-fit contact. The cover is integrally connected with the connector housing by a hinge. There are provided a pair of slits between the cover and the base plate and the base plate further comprises a pair of grooves each communicating with the respective slit and having width broadened toward both ends of the base plate.

The flat cable is conducted from the one of the grooves into the connector housing and is drawn to the opposite groove. The flat cable is curved along the first surface and the side surfaces to be in contact with the press-fit contacts by the cover.

According to the constitution described above, the flat cable can be in contact with the connector not only at an end but also at a middle portion thereof. Such a connection structure is hereinafter referred to as "through-connection". In contrast with prior arts, a plurality of cables branching off to the respective connectors are not necessary so that the weight and the cost can be suppressed.

The flat cable is curved and fixed along the first surface and the pair of side surfaces of the protruded connector housing by the cover. The flat cable is fixed frictionally by the above structure so that the contacts with the press-fit contacts are hardly affected in a case where a tension is applied to the flat cable and the reliability is assured. The contacts are covered with the cover so that the contacts are prevented from being damaged when the connector is installed into a vehicle body.

The flat cable is laid in the grooves having width broadened toward both ends of the base plate so that a direction of drawing the flat cable from the slit can be modified within a range allowable by the width of the grooves. Thus the arrangement of the connectors is not limited as a row on a straight line. The connection structure allows changing a direction of drawing the flat cable in a time of installing so as to make an advance in a work efficiency. Further, the flat cable needs not to be folded many times to change the direction, thereby a damage of the flat cable from folding is prevented. The flat cable is further prevented from a damage in a case where the upper surface of the connector is stuck to the vehicle panel because the flat cable is laid in the grooves.

The cover is formed integrally with the connector housing so as to be prevented from being lost or missed to be fixed.

DETAILED DESCRIPTION OF THE PREFERRED EMBODIMENT

A preferred embodiment of this invention will be described below. In this embodiment, the invention is applied to a bracket interconnection structure for fixing a sunvisor as an auxiliary component to an inner panel fixed above the front window in front of a driver's or a passenger seat.

Figure 1:
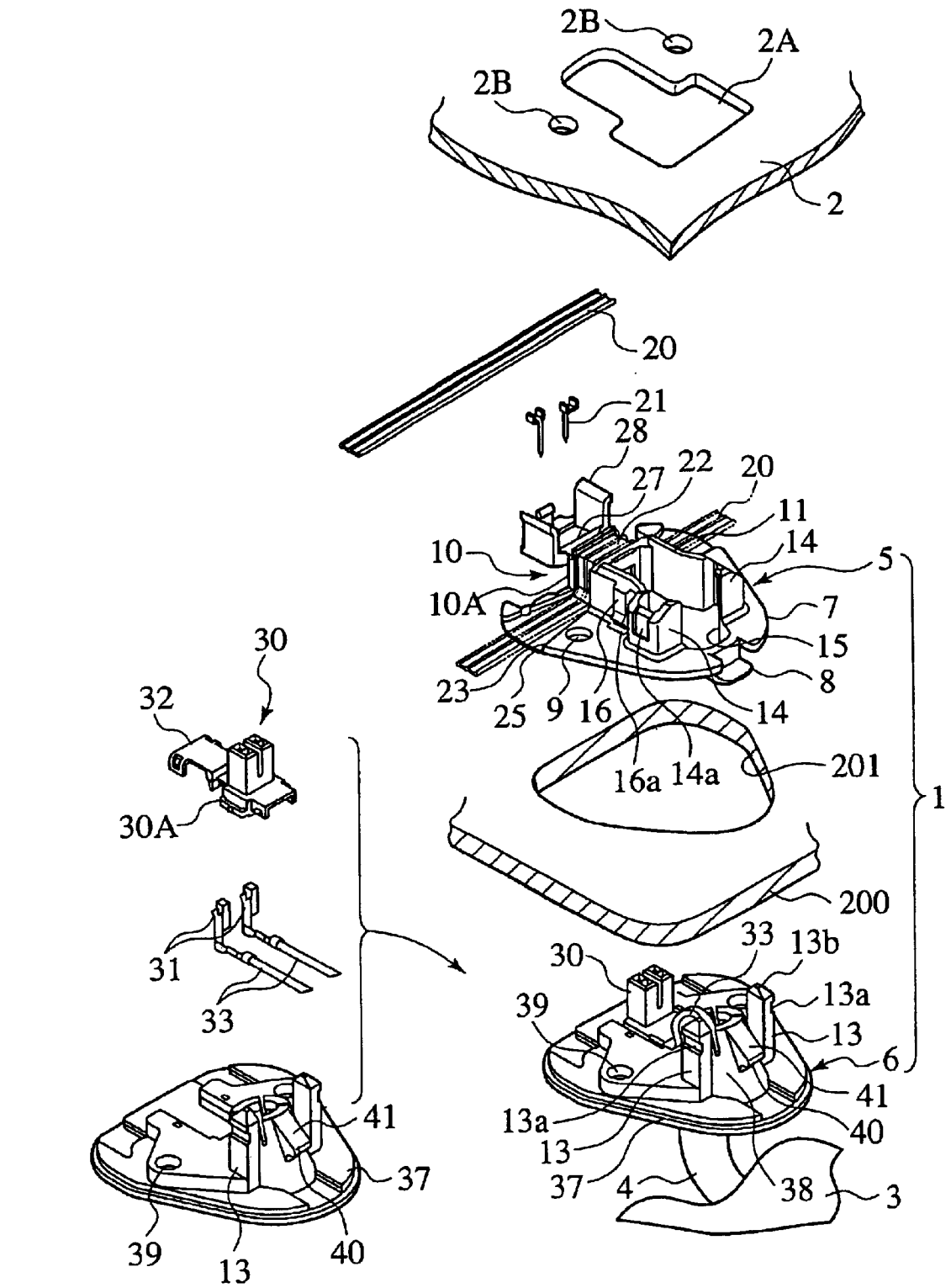
FIG. 1 is an exploded perspective view illustrating a connection structure of a flat cable to a connector according to an embodiment of the present invention.

As shown in FIG. 1, a bracket 1 to be mounted to a vehicle body according to the embodiment is a device for fixing a sunvisor 3 to an inner panel 2 of a vehicle, attached to the front end of a fixing shaft 4 supporting the sunvisor 3. The bracket 1 includes a first bracket 5 and a second bracket 6.

The bracket which is equipped to the rear side of a trim 200 as an interior within a vehicle passenger's compartment comprises a base plate 7 and is a base of structures such as a connector. The base plate 7 has a symmetrical rounded-triangle shape which is broader at its bottom end. The broader end is hereinafter referred to as "bottom end", and the narrower end as "top end", the axis of the symmetry as "bracket center line".

Figure 5:
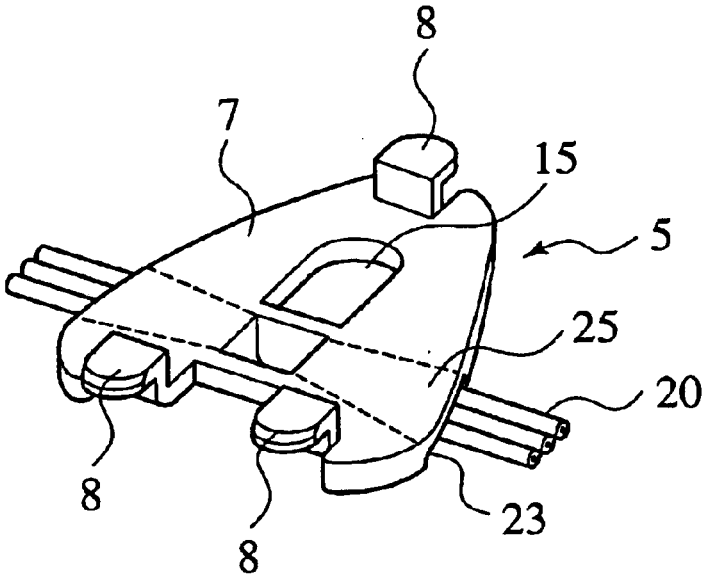
FIG. 5 is a perspective view of the first bracket and the flat cable showing a rear side thereof.

The base plate 7, as shown in FIG. 5, comprises three hooks 8 to engage with the periphery of an aperture 201 of the trim 200, one is at the top end and the other two are at the bottom end thereof. The hooks 8 are protruded from the lower surface of the base plate 7 and the end portions thereof are bent outward in a letter 'L' shape. The end portions recede from an outline of the base plate 7. The base plate 7 further comprises a pair of screw mounting holes 9 formed symmetrically therein so as to allow fixing to an inner panel 2.

The upper surface of the base plate 7 comprises a connector housing 10A of a connector portion 10 formed at the bottom end thereof and a pair of side walls 11 formed parallel to each other, each extended from the housing 10A, protruded at the top end thereof. The upper surface is further provided with a pair of tubular first engagement members 14 for engagement with a pair of engagement protrusions 13 provided to a second bracket 6 integral with each of the side walls 11. The connector housing 10A is composed of a pair of side surfaces with an upper first surface substantially parallel to the base plate 7.

A central aperture 15 is formed substantially to the center of the base plate 7 and closer than the connector housing 10A to the top end of the base plate. The side walls 11 and the first engagement members 14 are placed symmetrically along the central aperture 15. Said each engagement members 14 is composed of three side walls with one open side and is provided with a locking arm 14*a* on the wall opposite to the central aperture 15. The lower ends of the engagement members 14 are opened to receive the engagement protrusions 13 provided to the second bracket 6.

Each outer surface of the side walls 11 comprises a second engagement member 16 to be temporarily engaged with the inner panel 2 when disengaging the engagement between the connectors. Said each second engagement member 16 is further provided with an engagement groove 16*a* having a width equivalent to the thickness of the inner panel 2.

Figure 2:
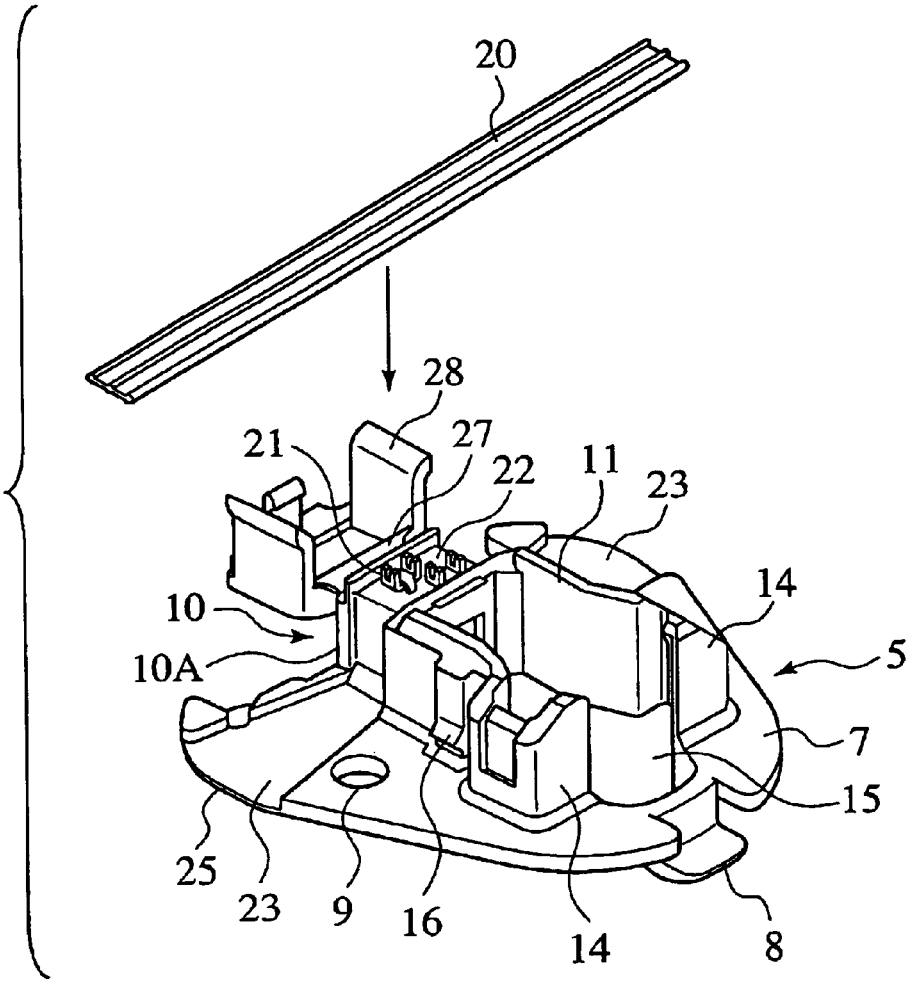
FIG. 2 is a magnified perspective view of a first bracket according to an embodiment of the present invention.

The connector housing 10A houses a plurality of terminals 21 as shown in FIG. 2. Each terminal 21 comprises: a press-fit contact at a top end thereof so as to be through-connected to a flat cable 20; and a needle-like terminal to be connected to an opposite terminal. An opposite connector provided to the second bracket 6 is inserted to the connector portion 10 from an aperture provided to a lower end thereof resulting in an electrical connection of the terminals 21 with opposite terminals 31 provided to an opposite connector 30.

The first surface and the side surfaces of the connector housing 10A further comprises a first groove 22 for housing the flat cable 20. The base plate 7 has a pair of second grooves 23 which are connected with the first grooves 22. The first groove 22 and the second grooves 23 form a shallow and relatively wide groove capable of housing the flat cable 20 and run across the first bracket 5 at a right angle to the 'bracket center line' The base plate 7 has a thin portion 25 at the first groove 22 and the second groove 23 so as to be capable of being elastically bent. The second grooves 23 have a width which gradually broadens from the connector housing 10A toward either side of the base plate 7.

The connector housing 10A is further provided with a cover 28 integrally connected thereto by a hinge 27. The cover 28 has a shape corresponding to the outer shape of the connector housing 10A. The cover 28 is capped on the connector housing 10A, and thereby the terminals 21 and the flat cable 20 are prevented from displacing and their electric contact is maintained. Though the cover 28 can be formed as a separate body from the connector housing 10A, the integral body as described in the embodiment is preferred to prevent the cover from being lost or omitted.

Figure 3:
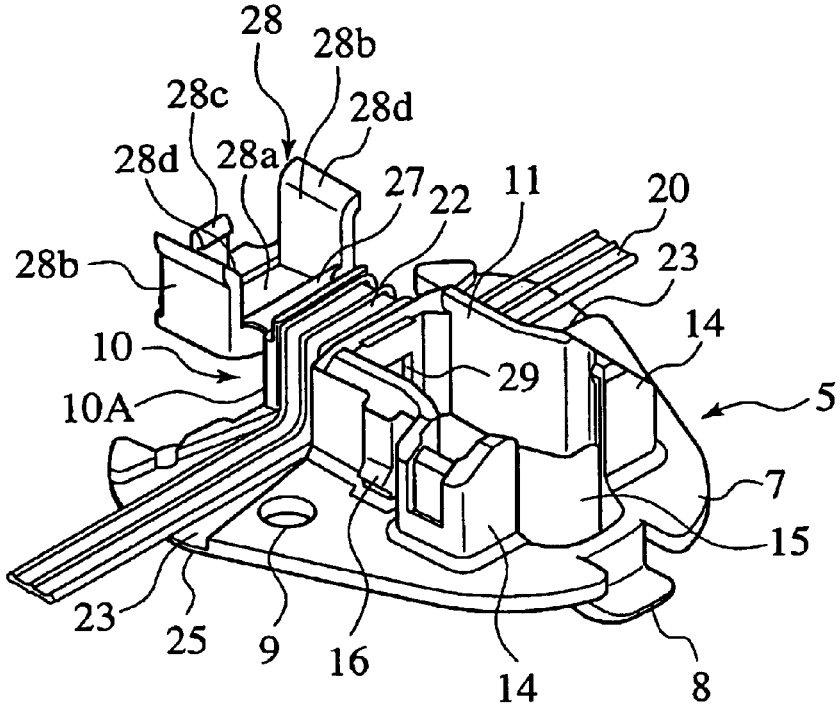
FIG. 3 is a perspective view showing a state in which a flat cable is laid on a connector housing protruded from the first bracket.

The cover 28 is, as shown in FIG. 3, composed of an upper wall portion 28*a*, a pair of side wall portions 28*b* and an engaging arm 28*c* opposite to the hinge 27 to be engaged with an engaging groove 29 provided to the connector housing 10A. The lower ends of the side wall portions 28*b* are bent outward in a rounded shape the inner surface thereof being an R-portion 28*d*. The outer surface of the upper wall portion 28*a* is formed as sloped surfaces 28*e* which slops from the center toward the either side thereof. The sloped surfaces 28*e* come to be the upper surfaces of the cover 28 covering the connector housing 10A and guiding the cover 28 to an aperture 2A which is opened on a panel 2 described later.

The inner panel 2 equipped with the first bracket 5 described above is, as shown in FIG. 1, provided with the aperture 2A whereto the connector portion 10, the first engagement members 14 and the second engagement members 16 are inserted. The aperture 2A has a wide portion whereto the first engagement members 14 and the second engagement members 16 are inserted and a narrow portion whereto the connector portion 10 is inserted. The second engagement portions 16 are inserted to the wide portion and are slid aside to be inserted to the narrow portion so that the engaging groove 16*a* is engaged with a periphery of the aperture 2A. The engagement keeps the first bracket 5 fixed to the inner panel 2 to prevent the trim 200 from excessive force applied when disengaging the engagement between the connectors. The inner panel 2 is further provided with a pair of openings 2B associated with the screw mounting holes 9.

A structure of the second bracket 6 supporting an auxiliary component mated with the first bracket 5 will be described below.

The second bracket 6 is fixed to the first bracket 5 with the trim 200 to be fixed to the inner panel 2 for interior decoration interposed therebetween. The second bracket is provided with a base plate 37 having substantially the same shape as the base plate 7 of the first bracket 5. A bottom end and a top end are hereinafter referred also for the second bracket 6 as the same definition as described above.

The second bracket 6 has a shaft holding member 38 for holding the front end of the fixing shaft 4. The shaft holding member 38 is protruded to reach the aperture 2A of the inner panel 2 when being inserted to the central aperture 15 of the first bracket 5.

A hook 40 is integrally formed on the shaft holding member 38 at a side facing to the top end thereof to be engaged with a periphery of the aperture 2A. The hook 40 comprises a sloped surface 41 sloping toward the top end of the bracket 6. The sloped surface 41 slips on the periphery of the aperture 2A so as to slide the bracket 6 toward the bottom end in a case where the hook 40 goes into the aperture 2A.

An opposite connector 30 housing a plurality of opposite terminals 31 is fixed on the upper surface of the second bracket 6. The opposite terminals 31 are connected with an end of a cable 33 of a sunvisor drawn from the fixing shaft 4 of the shaft holding member 38. Inserting the opposite terminals 31 to a connector housing 30A from a lower side thereof and shutting a lid 32 integrally connected to the lower side of the connector housing 30A result in composing the opposite connector 30. The opposite connector 30 is fixed on the upper surface of the base plate 37 by sliding to be engaged with a slot provided to the second bracket 6. The opposite connector 30 is mated with the connector portion 10 of the first bracket 5.

A pair of screw mounting holes 39 are formed on the base plate 37 of the second bracket 6 and are placed in accordance with the screw mounting holes 9 of the first bracket 5 and the openings 2B of the inner panel 2.

A pair of engagement protrusions 13 are formed in an upwardly protruding manner on opposite sides of the shaft holding member 38. The protrusions 13 extend to a higher level than the opposite connector 30. In connecting the second bracket 6 to the first bracket 5, the engagement protrusions 13 are inserted into the respective first engagement members 14 of the first bracket 5 before the opposite connector 30 is fitted into the connector portion 10. Thus a movement of connecting the second bracket 6 to the first bracket 5 is guided by the engagement protrusions 13.

A fixing structure of the above brackets 5 and 6 to the inner panel 2 will be described below.

A connection of the flat cable 20 and the connector portion 10 has to be completed before the first and second brackets 5 and 6 are fixed to the inner panel 2.

Figure 4:
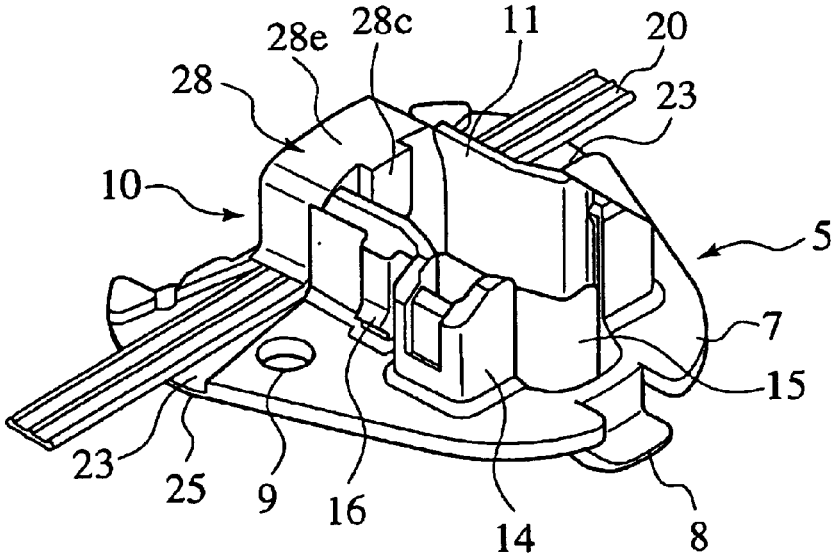
FIG. 4 is a perspective view showing a state in which a cover is fitted, further to the state shown in FIG. 3.
Figure 6:
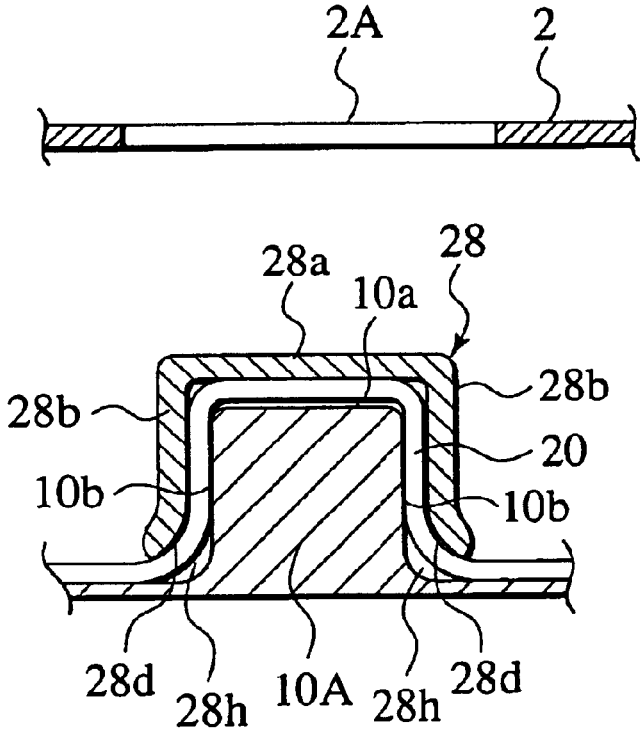
FIG. 6 is a cross sectional view of the connector housing in the state shown in FIG. 4.

An intermediate portion of the flat cable is, as shown in FIG. 2 and FIG. 3, laid in the first groove 22 provided to the upper surface of the connector housing 10A and is press-fit to the terminal 21 housed in the connector housing 10A. In other words, the flat cable 20 is 'through-connected' to the connector portion 10. Next, the cover 28 is capped on the connector housing 10A as shown in FIG. 4 so that the flat cable 20 is curved along the first surface and the side surfaces of the connector housing 10A. The state is illustrated in FIG. 6 as a cross sectional view thereof. Each side wall portion 28*b* and the upper wall portion 28*a* make a right angle so that the flat cable 20 is curved substantially at a right angle. In a case where a tension is applied to the flat cable 20, the curved portions stand the tension to prevent that an excessive force is applied to the contact portion.

There are provided a pair of slits 28*h* between the lower end 28*d* of the cover 28 and the upper surface of the base plate 7 so that the direction of drawing the flat cable 20 therefrom is changed. The flat cable 20 is drawn from the slit 28*h* and conducted to the second groove 23 on the upper surface of the base plate 7. The second grooves 23 have a width which gradually broadens toward each end of the base plate 7 so that a direction of drawing the flat cable 20 from the slits 28*h* can be modified within a range allowable by the width of the second grooves 23. Thereby a plurality of connectors can be connected to a flat cable 20 in a case where the connectors are not placed in a row on a straight line.

The flat cable 20 is easy to be curved in a direction vertical to the flat surface thereof but is hardly curved in an in-plane direction. There is no need to multifold the flat cable 20 to change a direction thereof, thereby it is prevented that the multifolded portion deforms the trim 200 or damages the flat cable 20 itself.

By anticipation that the first and second brackets 5 and 6 are fixed to the inner panel 2, the first bracket 5 is inserted into the back of the trim 200 to be engaged with the periphery of the aperture 201 by the hook 8 thereof. The process should be achieved before installing the trim 200 to the inner panel 2.

The engagement of the hook 8 with the trim 200 is achieved with elastically bending the bracket 5 at the thin portion 25 as shown in FIG. 7A to FIG. 7D.

Figure 7A:
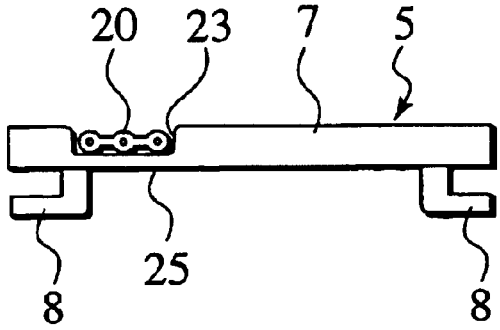
FIG. 7A to FIG. 7D are cross sectional views of the first bracket and a trim of a vehicle showing an installation step thereof, according to an embodiment of the present invention.
Figure 7B:
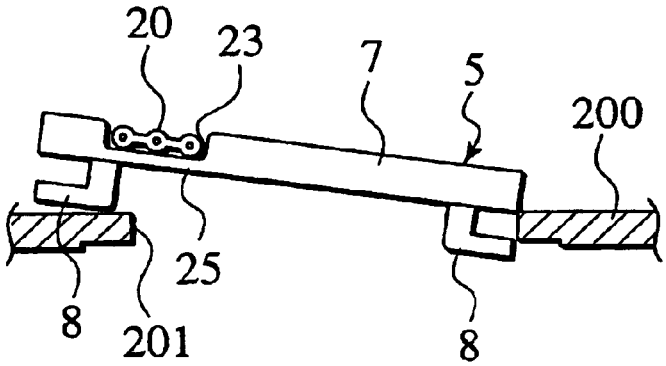
Figure 7C:
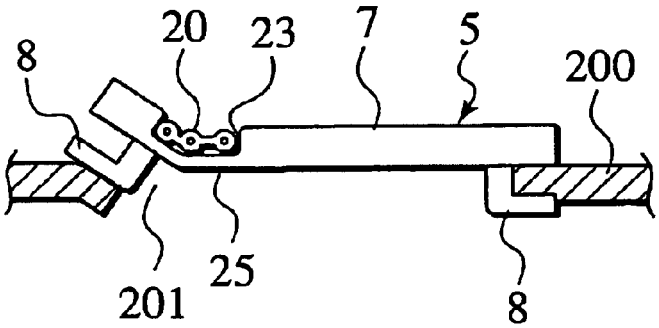
Figure 7D:
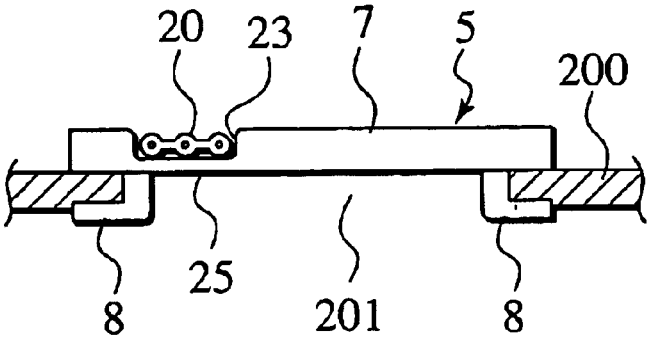

For a start, the top end of the first bracket 5 is inserted to the aperture 201 of the trim 200 as shown in FIG. 7A so that the hook 8 at the top end is hooked to the periphery of the aperture 201. Next the bottom end of the base plate 7 is pushed to the trim 200 to elastically bend the thin portion 25 as shown in FIG. 7C, thereby the other hooks 8 go through the periphery of the aperture 201 to be engaged therewith as shown in FIG. 7D. The hooks 8 are engaged with the trim 200 without an excessive force, therefore the installation labor come to be easier and the periphery of the aperture 201 and the hooks 8 are prevented from broken. There are no changes in a case where the flat cable 20 is housed in the first and second grooves 22 and 23.

Next the trim 200 is installed to the inner panel 2. At the time, the flat cable 20 is housed in the first and second grooves 22 and 23 which are formed on the surfaces of the connector housing 10A and the base plate 7 so as not to slip from the position. Through-connection of the intermediate portion of the flat cable 20 to the connector portion 10 results in that the labor of wiring the flat cable 20 within a vehicle roof comes to be easier.

The 'through-connection' of the flat cable 20 and the connector portion 10 can be processed either before or after the installation of the first bracket 5 to the trim 200. Even in case where the connection of the flat cable 20 to the connector portion 10 is preceded, the thin portion 25 is capable of being elastically bent so that the hook 8 can be easily engaged with the periphery of the aperture 201 without an excessive force applied to the flat cable 20 nor connector portion 10.

Figure 8:
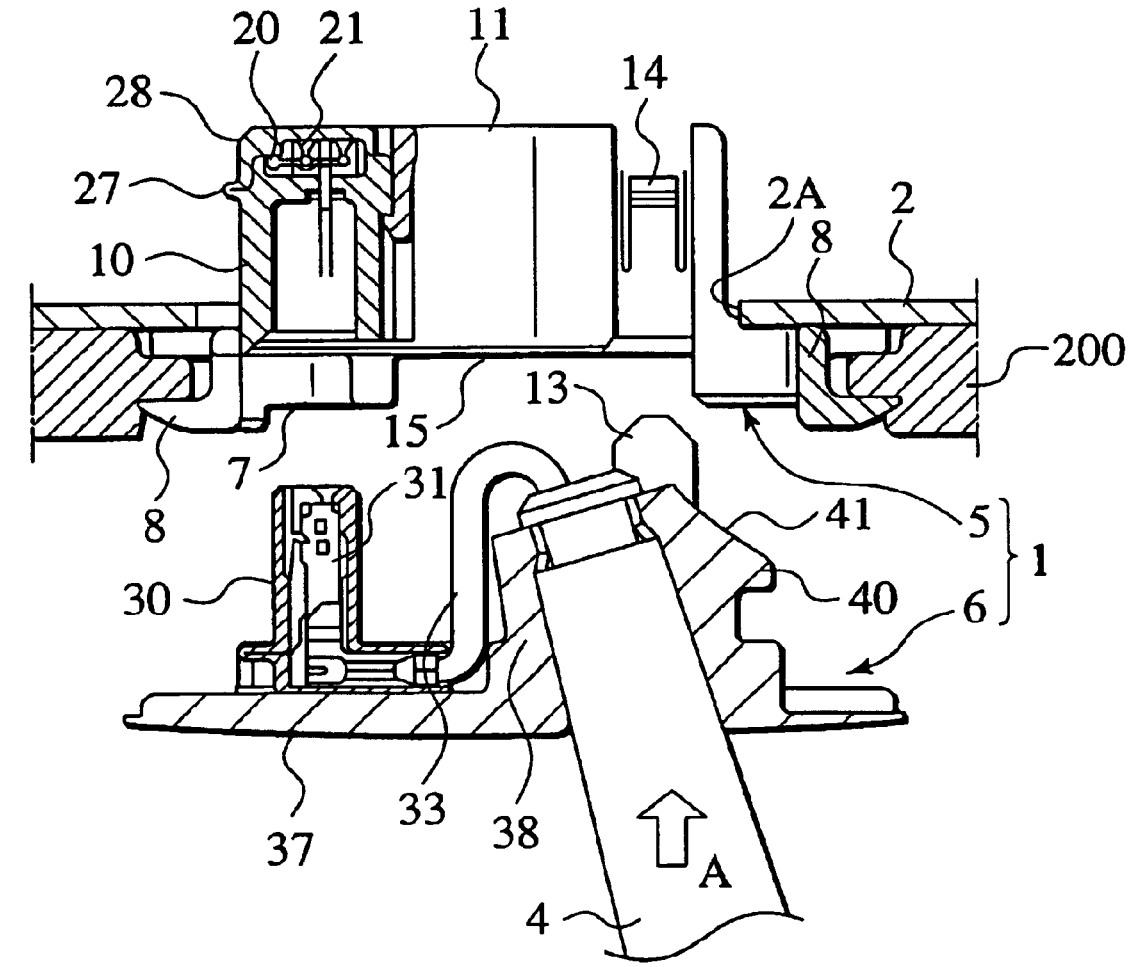
FIG. 8 to FIG. 10 are cross sectional views of the second bracket and the first bracket according to an embodiment of the present invention showing an engagement step.

At a time of installing the trim 200 to the inner panel 2, the protruded portions of the first bracket 5, more specifically, the connector portion 10, the first engagement members 14 and the side walls 11 and such are, as shown in FIG. 8, inserted to the aperture 2A of the inner panel 2. In the state, the first bracket 5 is installed at the lower surface of the inner panel 2 as the side to be engaged with the second bracket 6 faces downward.

In the state, the opposite connector 30, the engagement protrusions 13 and the shaft holding member 38 are opposed to the connector portion 10, the first engagement member 14 and the central aperture 15 respectively so that the first bracket 5 is engaged with the second bracket 6. Pressing the second bracket 6 to the first bracket 5 in a direction shown in FIG. 8 as an arrow 'A' results in that the engagement protrusions 13 of the highest protruded portion among the portions provided to the second bracket 6 reach to the first engagement members 14 provided to the first bracket 5 so as to be engaged therewith at first of all. The upper portion of each engagement protrusion 13 is in a quadrangular prism or circular cone shape. The upper portions in such a shape guide the protrusions 13 into the first engagement members 14 during insertion. Thus the second bracket 6 is guided to a correct position to be engaged with the first bracket 5. This allows reliable connecting operation of the connector portion 10 and the opposite connector 30, and also, the first and second brackets 5 and 6.

Figure 9:
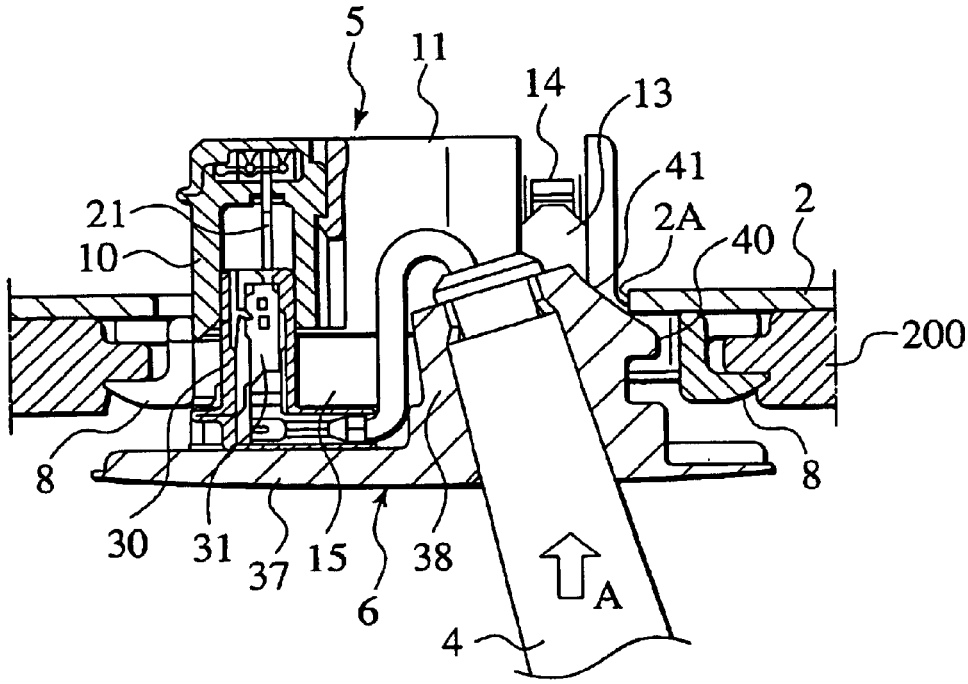
Figure 10:
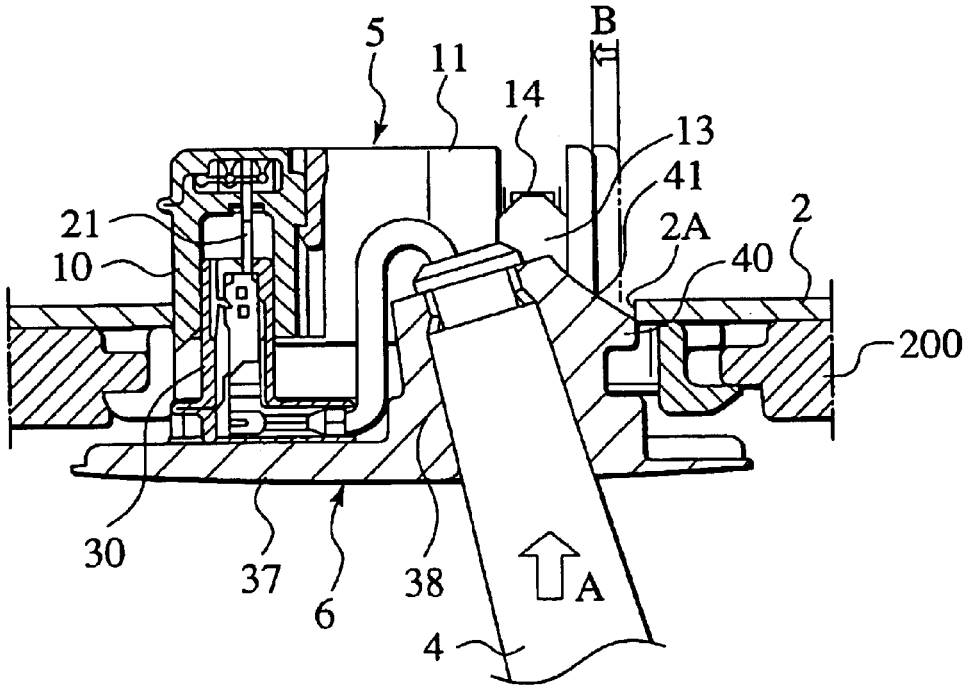

The sloped surface 41 provided to the hook 40 of the second bracket 6 abuts the periphery of the aperture 2A as shown in FIG. 9 when the connector portion 10 is in the process of engaging with the opposite connector 30. Further pressing the second bracket 6 results in that the sloped surface 41 guides the first and second brackets 5 and 6 to slide in a direction of arrow 'B' shown in FIG. 10. Thus the hook 40 goes through the aperture 2 to be inserted into the back side of the inner panel 2 and, in parallel, the connector portion 10 and the engagement protrusions 13 are engaged with the opposite connector 30 and the first engagement members 14 respectively.

Figure 11:
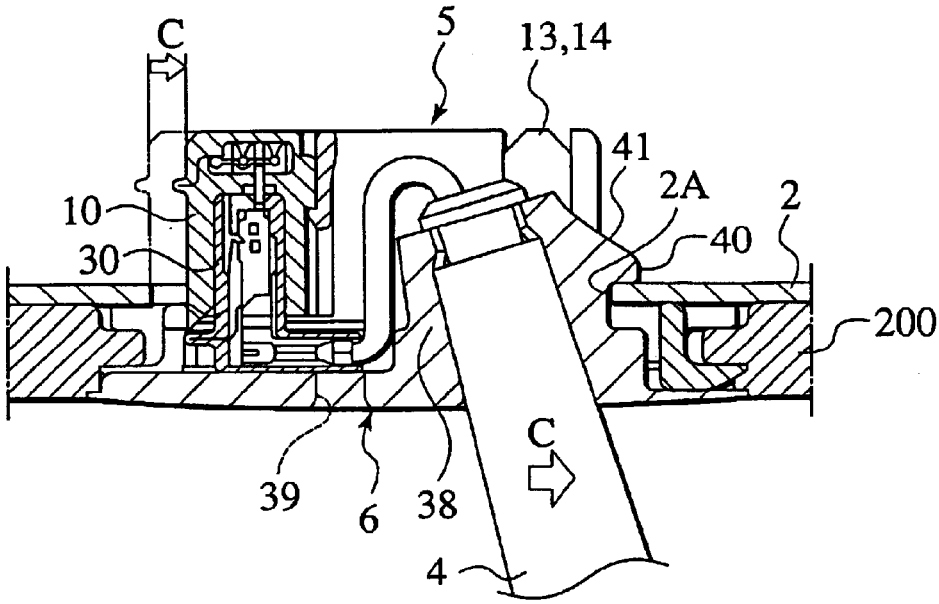
FIG. 11 is a cross sectional view showing a state in which the second bracket is engaged with the first bracket.
Figure 12:
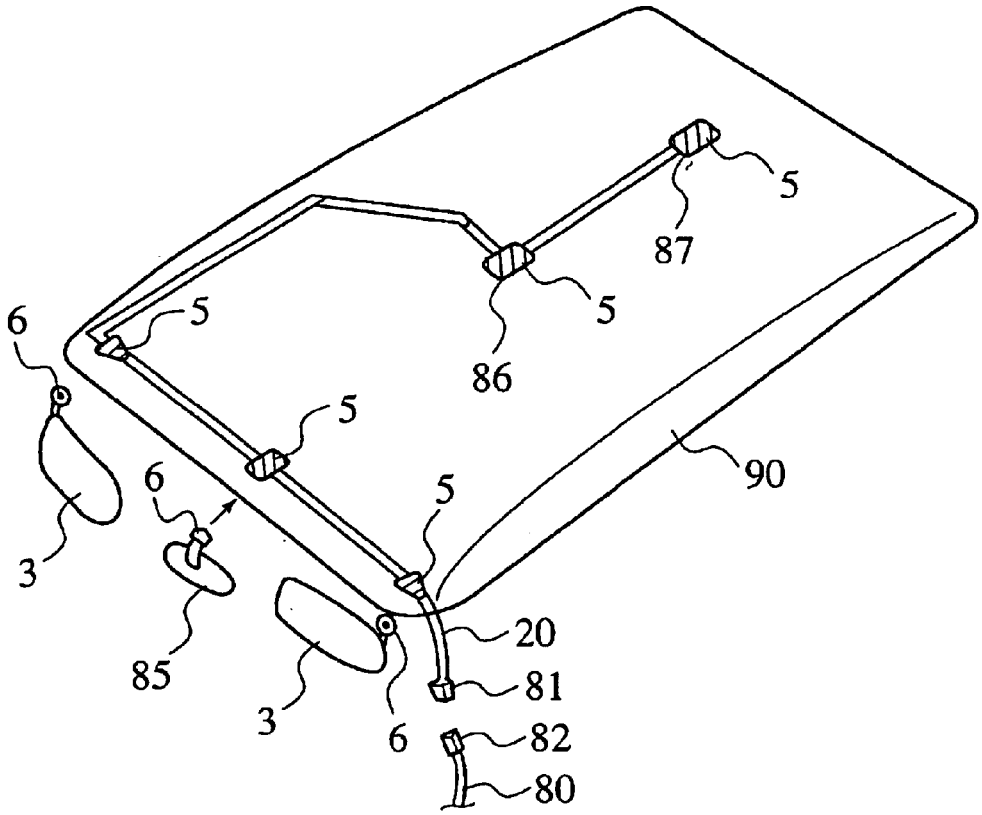
FIG. 12 is a perspective view showing wiring to the respective auxiliary components according to an embodiment of the present invention.

The engagements of the connector portion 10 to the opposite connector 30 and the engagement protrusions 13 to the first engagement members 14 are confirmed by the respective click noises. After confirmation of the engagements, the hook 40 is engaged with the periphery of the aperture 2A by sliding the first and second brackets 5 and 6 in a direction of the arrow shown in FIG. 11. Simultaneously the screw mounting holes 9 of the first bracket 5, the screw mounting holes 39 of the second bracket 6 and the openings 2B of the inner panel 2 are positioned to be associated so that they are fixed by screws. Thus the installation of the sunvisor 3 is finished.

What is claimed is:

1. A connection structure for connecting a flat cable to a connector, comprising:

a connector housing protruding from a base plate comprising:

a first surface substantially parallel to the base plate; and a pair of side surfaces on both sides of the first surface;

a plurality of terminals housed in the connector housing each having a press-fit contact exposed from the first surface;

a fiat cable having a plurality of conductors each in contact with the respective press-fit contact;

a cover covering the first surface and the side surfaces of the connector housing; and a pair of slits between the cover and the base plate that allows a direction of the flat cable therefrom to be regulated;

wherein the flat cable is curved along the first surface and the side surfaces by the cover so as to be in contact with the press-fit contacts;

wherein the base plate further comprises a pair of grooves each communicating with the respective slit and having a width which broadens toward each end of the base plate; and wherein the grooves house the flat cable.

2. The connection structure of claim 1, wherein;

the cover is integrally connected with the connector housing by a hinge.

3. A connection structure for connecting a flat cable to a connector, comprising:

a connector housing protruding from a base plate comprising:

a first surface in a plane different from the base plate; and a pair of side surfaces each adjacent to the first surface;

a plurality of terminals in the connector housing having retaining contacts on the first surface;

a flat cable having a plurality of conductors in contact with the retaining contacts;

a cover covering the first surface and the side surfaces of the connector housing, the cover holding the flat cable adjacent to the first surface and side surfaces; and a pair of slits between the cover and the base plate configured to allow orientation of the flat cable, wherein the base plate further comprises a pair of grooves that widen in width as the groove extends from the pair of slits, the grooves housing the flat cable.

4. The connection structure of claim 3, wherein the cover is integrally connected to the connector housing.

* * * * *